US011946221B2

(12) United States Patent
DeWind et al.

(10) Patent No.: US 11,946,221 B2
(45) Date of Patent: Apr. 2, 2024

(54) GROUND EXCAVATION SHIELD APPARATUS WITH GUIDE RAILS

(71) Applicant: DeWind One-Pass Trenching, LLC, Zeeland, MI (US)

(72) Inventors: Ryan DeWind, Zeeland, MI (US); Gregory Allen DeWind, Zeeland, MI (US)

(73) Assignee: One Pass Innovators, LLC, Zeeland, MI (US)

( * ) Notice: Subject to any disclaimer, the term of this patent is extended or adjusted under 35 U.S.C. 154(b) by 252 days.

(21) Appl. No.: 17/031,145

(22) Filed: Sep. 24, 2020

(65) Prior Publication Data

US 2022/0090354 A1 Mar. 24, 2022

(51) Int. Cl.
*E02F 5/10* (2006.01)

(52) U.S. Cl.
CPC ..... *E02F 5/10* (2013.01)

(58) Field of Classification Search
CPC ..... E02F 5/10; E02D 17/086; E02D 17/08
USPC ..... 405/282, 283
See application file for complete search history.

(56) References Cited

U.S. PATENT DOCUMENTS

| | | | | |
|---|---|---|---|---|
| 4,202,649 | A * | 5/1980 | Cook | E02D 17/08 405/282 |
| 5,527,137 | A * | 6/1996 | Spencer | E02D 17/08 405/282 |
| 7,607,863 | B2 * | 10/2009 | Paull | E02F 5/101 405/175 |
| 2016/0108599 | A1 * | 4/2016 | Spry | E02D 17/08 405/282 |
| 2018/0209114 | A1 * | 7/2018 | Foley | E02D 17/08 |

* cited by examiner

*Primary Examiner* — Sean D Andrish
(74) *Attorney, Agent, or Firm* — The Watson IP Group, PLC; Jovan N. Jovanovic

(57) ABSTRACT

A ground excavation shield that can include a first wall, a second wall, and a third wall, a first guide rail, and a second guide rail. The first wall can be disposed on a first side of the ground excavation shield. The second wall can be disposed on a second side of the ground excavation shield. The third wall can be disposed on a third side of the ground excavation shield and can be coupled to the first and second walls. The first guide rail can be coupled to a bottom of the first wall and the second guide rail can be coupled to a bottom of the second wall.

10 Claims, 9 Drawing Sheets

GROUND EXCAVATION SHIELD APPARATUS WITH GUIDE RAILS

CROSS-REFERENCE TO RELATED APPLICATION

NA

BACKGROUND OF THE DISCLOSURE

1. Field of the Disclosure

The disclosure relates in general to ground excavation, and more particularly, to a ground excavation shield apparatus with guide rails.

2. Background Art

Ground excavation is used for a variety of purposes. For example, ground excavation can be used for mining, demolition, grading, landscaping, digging of trenches, holes, and foundations, etc. During such ground excavation, it is desirable to use some sort of shield to at least mitigate ground and other materials excavated from an excavation site from being scattered into areas proximate to and surrounding the excavation site. Such ground excavation shields are known in the art, having a flat bottom that contacts a ground of the excavation site.

SUMMARY OF THE DISCLOSURE

The disclosure is directed to a ground excavation shield that can include a first wall, a second wall, a third wall, a first guide rail, and a second guide rail. The first wall can be disposed on a first side of the ground excavation shield. The second wall can be disposed on a second side of the ground excavation shield. The third wall can be disposed on a third side of the ground excavation shield and can be coupled to the first and second walls. The first guide rail can be coupled to a bottom of the first wall and the second guide rail can be coupled to a bottom of the second wall.

In some configurations, the first and second guide rails can be one of "V" shaped, "W" shaped, and an inverted "V" shaped.

In some configurations, a third guide rail can be coupled to a bottom of the third wall.

In some configurations, at least one extension can be coupled to at least one top of the first, second, and third walls.

In some configurations, the at least one extension can include three extensions coupled to the first, second, and third walls, respectively, at the top of the ground excavation shield.

In some configurations, the ground excavation shield can include a fourth wall on a fourth side of the ground excavation shield.

In some configurations, a fourth guide rail can be coupled to a bottom of the fourth wall.

In some configurations, at least one coupler can be coupled to at least one of the walls of the ground excavation shield. The at least one coupler can be used to couple the ground excavation shield to a ground excavator while the ground excavator drags the ground excavator shield across a ground.

In some configurations, a system can include the ground excavation shield, the system can further include a ground excavator.

In some configurations, the ground excavator can be a trencher.

In some configurations, the third wall can include a plurality of wall members. The plurality of wall members can reduce an area of an interior of the ground excavation shield proximate to the third wall.

In some configurations, the plurality of wall members can include a central wall member coupled to two side wall members.

In some configurations, the central wall member can be coupled to the two side wall members at approximately 45 degrees.

BRIEF DESCRIPTION OF THE DRAWINGS

The disclosure will now be described with reference to the drawings wherein.

DETAILED DESCRIPTION OF THE DISCLOSURE

Figure 1:
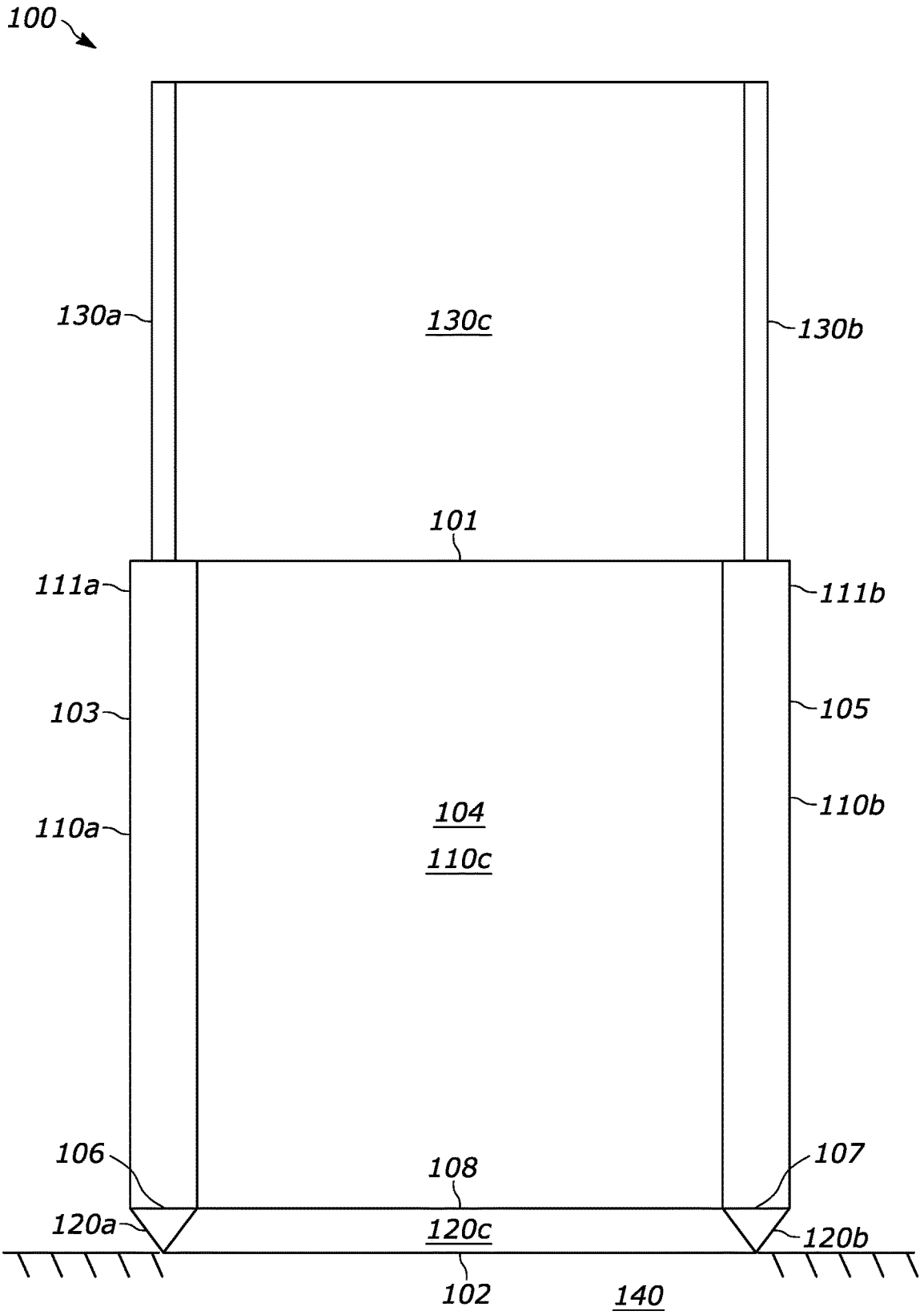
FIG. 1 illustrates a front view of an example ground excavation shield, in accordance with at least one embodiment disclosed herein.
Figure 2:
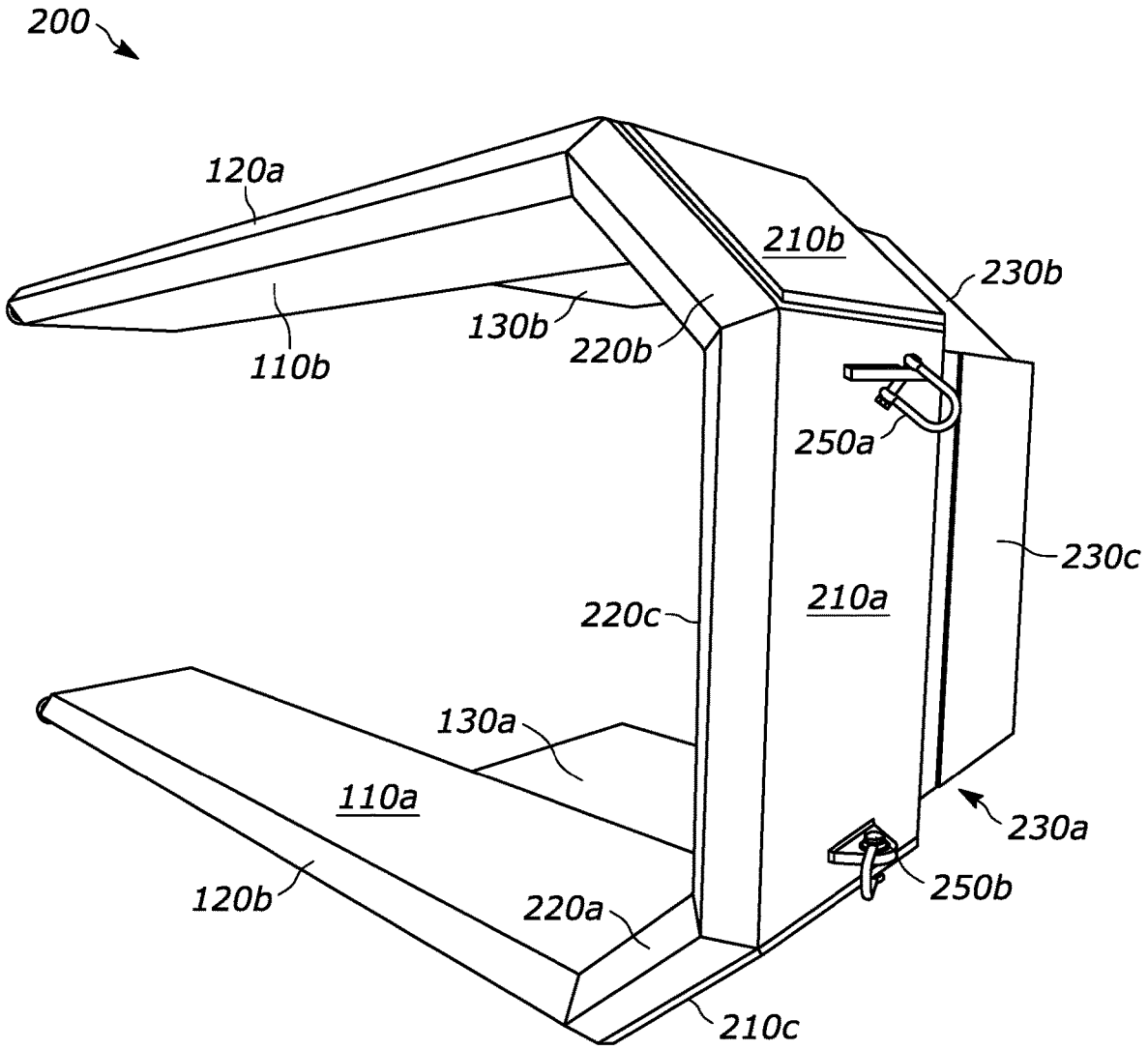
FIG. 2 illustrates an isometric view of another example ground excavation shield, in accordance with at least one embodiment disclosed herein.
Figure 3:
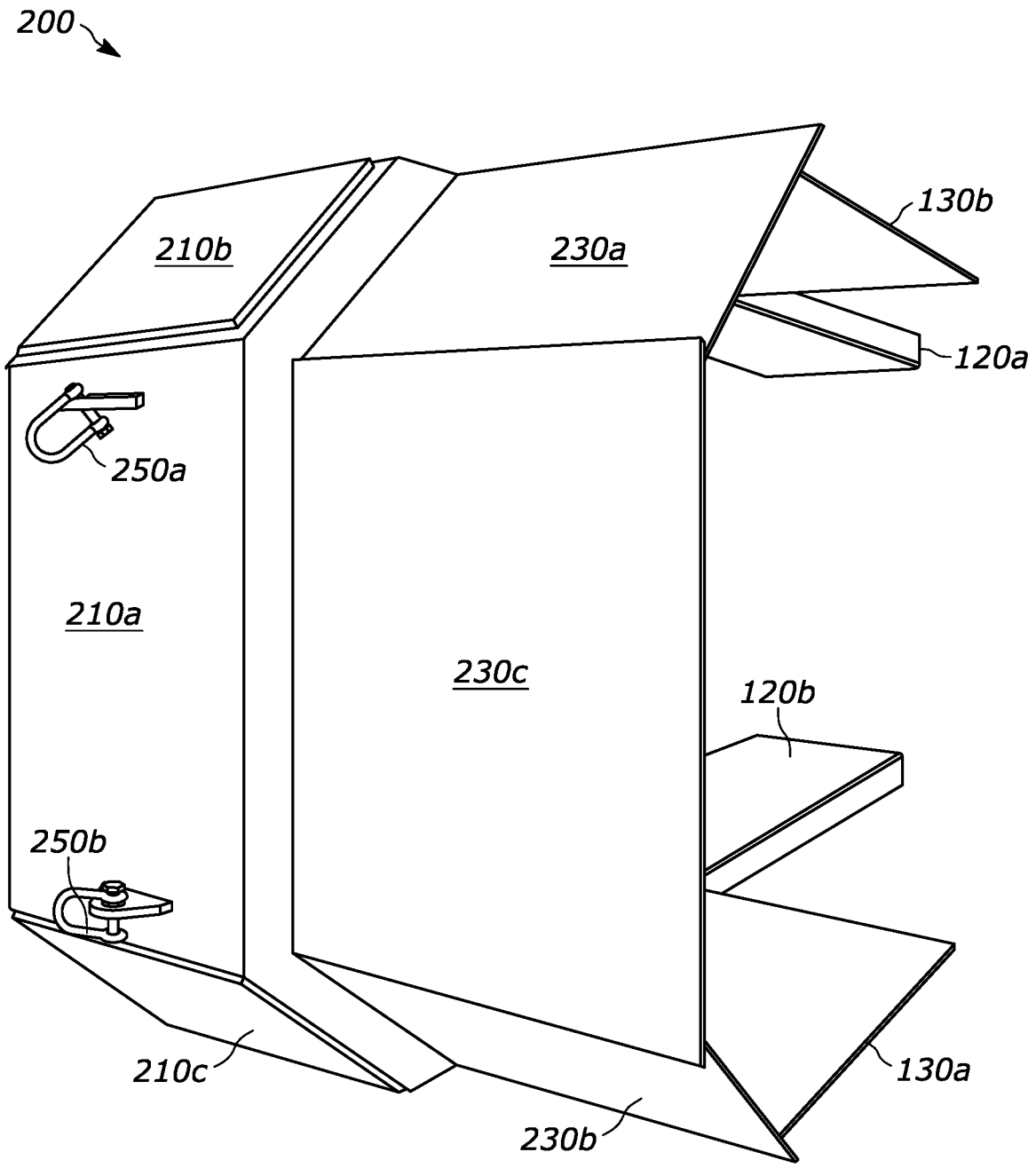
FIG. 3 illustrates another isometric view of the ground excavation shield shown in FIG. 2, in accordance with at least one embodiment disclosed herein.
Figure 4:
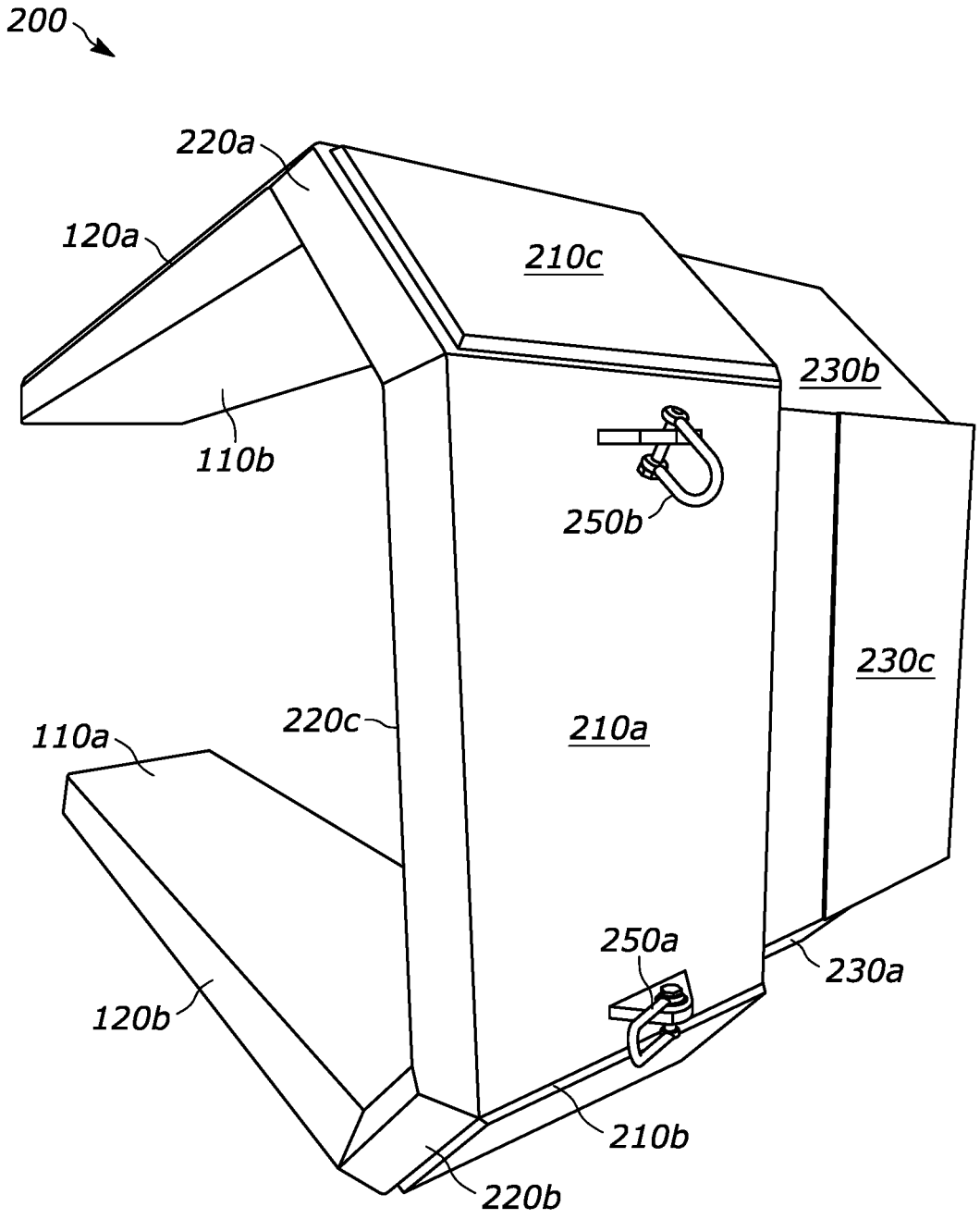
FIG. 4 illustrates another isometric view of the ground excavation shield shown in FIG. 2, in accordance with at least one embodiment disclosed herein.
Figure 5:
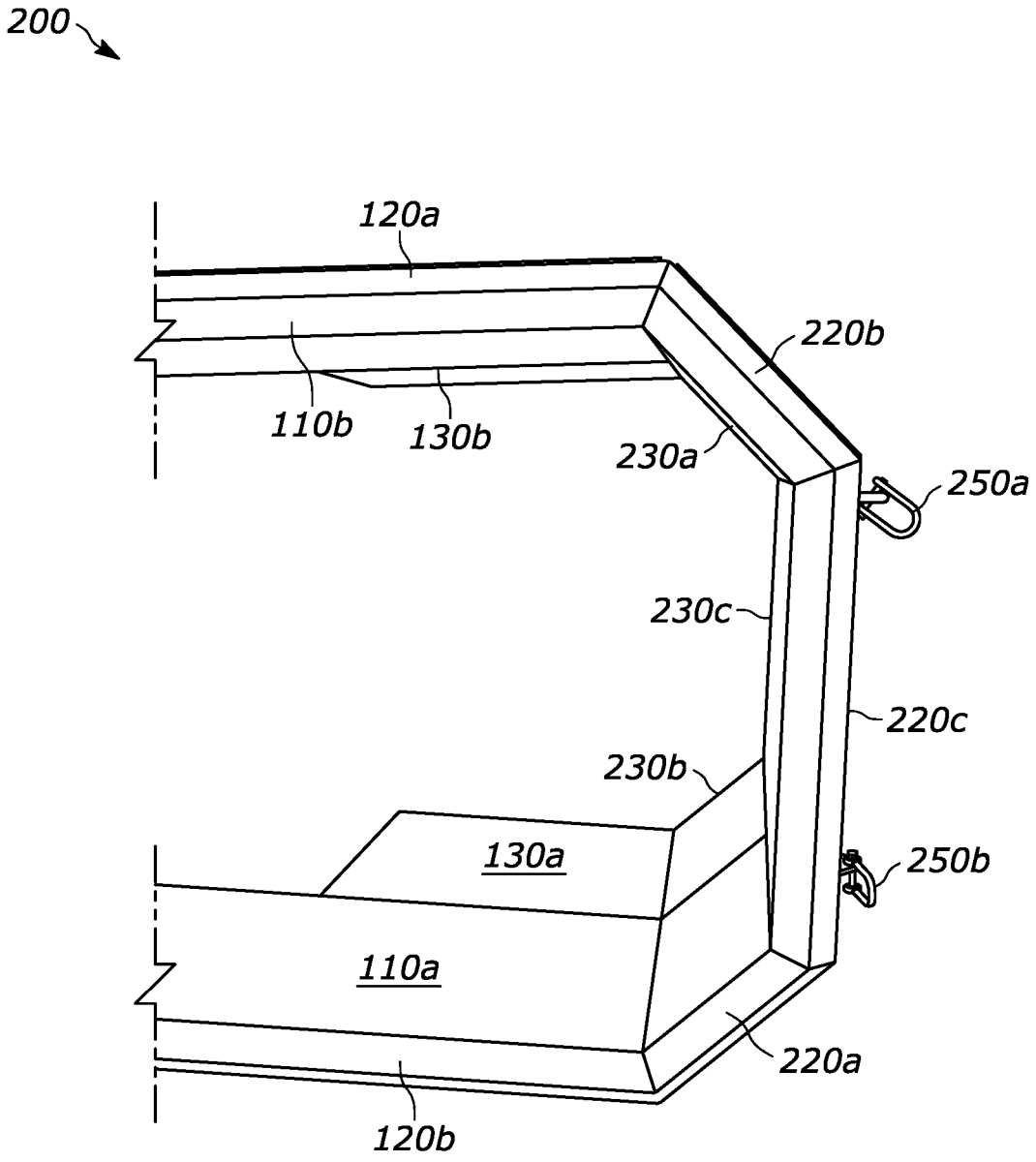
FIG. 5 illustrates another isometric view of the ground excavation shield shown in FIG. 2, in accordance with at least one embodiment disclosed herein.
Figure 6:
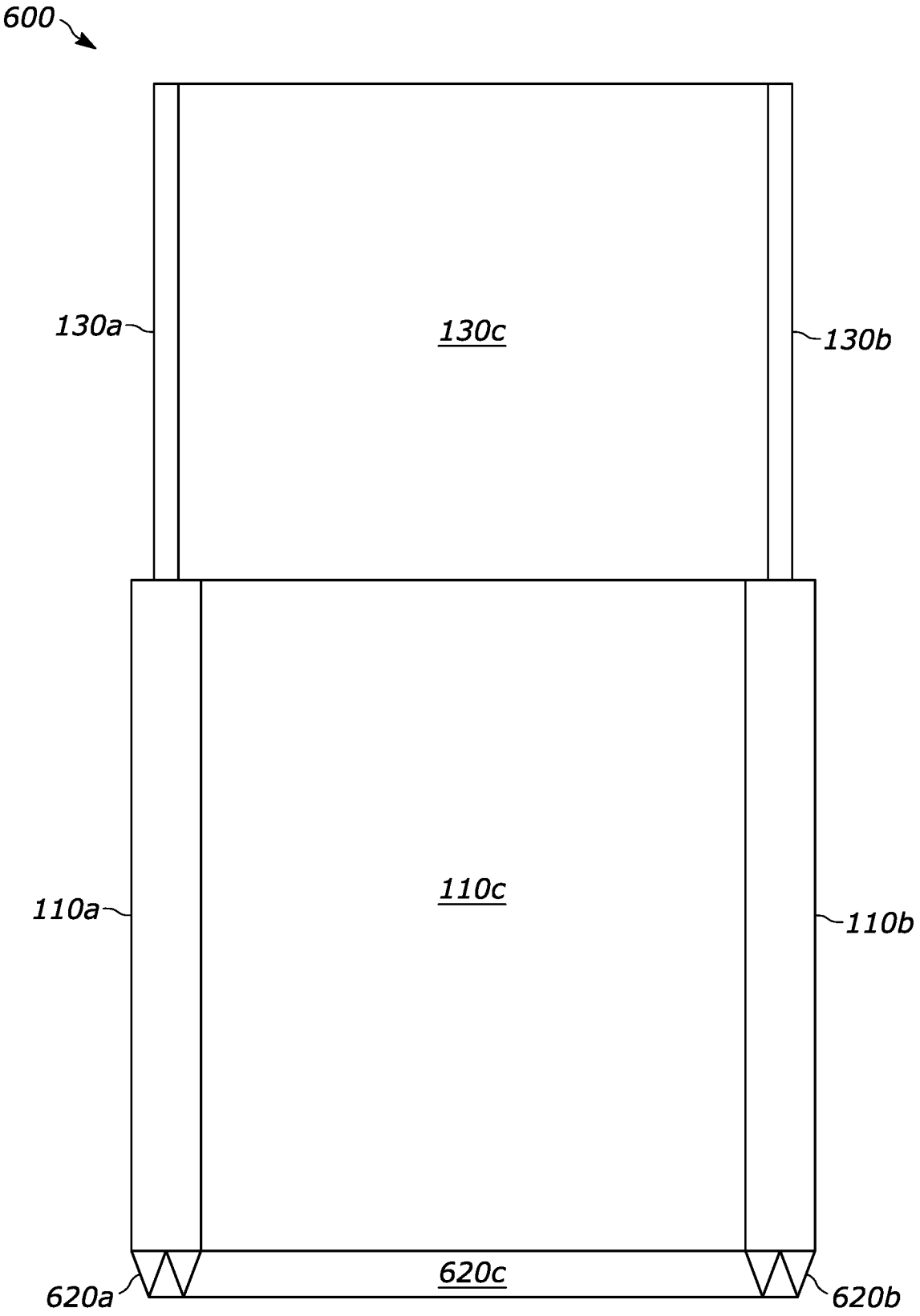
FIG. 6 illustrates a front view of another example ground excavation shield, in accordance with at least one embodiment disclosed herein.

While this disclosure is susceptible of embodiment(s) in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

It has become appreciated that typical ground excavation shields based on existing shield technology having a flat bottom that contacts a ground have a deficiency. For example, such existing ground excavation shields can be moved along the ground relatively easily when unintentionally bumped by a heavy construction equipment excavator.

Moreover, in some applications it is desirable to drag a ground excavation shield in a straight line. Existing flat bottom ground excavation shields do not track well in a straight line. For example, when dragged across rocks and other debris in the ground existing flat bottom ground excavation shields are relatively easily pushed into different directions, preventing them from tracking in a straight line. The embodiment(s) discussed herein at least partially mitigate such problems associated with typical flat bottom ground excavation shields.

Referring now to the drawings and in particular to FIG. 1, an apparatus is disclosed, such as a ground excavation shield 100. The ground excavation shield 100 includes a first wall 110*a* disposed on a first side 103 of the ground excavation shield 100, a second wall 110*b* disposed on a second side 105 of the ground excavation shield 100, and a third wall 110*c* on a third side 104 of the ground excavation shield 100. In the configuration shown, the third wall 110*c* is coupled to the first and second walls 110*a* and 110*b* at first and second sides 111*a*/111*b* of the third wall 110*c*. In at least one embodiment, the third wall 110*c* is coupled perpendicular to the first and second walls 110*a* and 110*b*. In other configurations the third wall 110*c* is coupled to the first and second walls 110*a* and 110*b* at angles greater than and less than 90 degrees depending upon the needs of the job site. Irrespective of the angle between the third wall 110*c* and the first and second walls 110*a* and 110*b*, the heights of the first, second, and third walls 110*a*/110*b*/110*c* are approximately (+−5%) the same such that when coupled the first, second, and third walls 110*a*/110*b*/110*c* form an horizontal plane along the top 101 of the ground excavation shield 100 and a horizontal plane along the bottom 102 of the ground excavation shield 100, allowing the ground excavation shield 100 to lie flat against the ground 140. In at least one other embodiment, the first, second, and third walls 110*a*/110*b*/110*c* can be different heights.

The ground excavation shield 100 further includes a first guide rail 120*a* coupled to a bottom 106 of the first wall 110*a* and a second guide rail 120*b* coupled to a bottom 107 of the second wall 110*b*. In at least one embodiment, the ground excavation shield 100 can further includes a third guide rail 120*c* coupled to a bottom 108 of the third wall 110*c*. With the first, second, and third walls 110*a*/110*b*/110*c* coupled together with the first, second, and third guide rails 120*a*/120*b*/120*c*, as shown, a bottom 102 for the ground excavation shield 100 is formed. The first, second, and third guide rails 110*a*/120*b*/120*c* can be secured to the first, second, and third walls 110*a*/110*b*/110*c*, respectively, via welding, bolting, bonding, and/or any other way that prevents the first, second, and third guide rails 110*a*/120*b*/120*c* from detaching from the first, second, and third walls 110*a*/110*b*/110*c* when the ground excavation shield 100 is dragged across a ground 140. The first, second, and third walls 110*a*/110*b*/110*c* and the first, second, and third guide rails 120*a*/120*b*/120*c* can be any length needed for a particular work site. Although the first, second, and third guide rails 120*a*/120*b*/120*c* are shown as being a same length as the first, second, and third walls 110*a*/110*b*/110*c*, in at least one other embodiment the and the first, second, and third guide rails 120*a*/120*b*/120*c* can be longer or shorter, individually or all, than the first, second, and third walls 110*a*/110*b*/110*c*, without departing from the scope of the embodiment(s) disclosed.

In at least one embodiment, the third wall 110*c* can include at least two wall members, shown as ground excavation shield 200. For example, the third wall 110*c* can include a central wall member 210*a* that is coupled to two side wall members 210*b*/210*c* (FIGS. 2-6). In at least one embodiment, the central wall member 210*a* and the two side wall members 210*b*/210*c* can be coupled at approximately (+−10%) 45 degrees, such that the width/area of the interior of the ground excavation shield 200 is reduced proximate to the third wall 110*c*. The central wall member 210*a* and the two side wall members 210*b*/210*c* can be secured via welding, bolting, bonding, and/or any other way that prevents central wall member 210*a* and the two side wall members 210*b*/210*c* from detaching from each other when the ground excavation shield 200 is dragged across a ground 140. In at least one embodiment, the third guide rail 120*c* can include at least two guide rail members. For example, the third guide rail 120*c* can include a central guide rail member 220*c* that is coupled to two side guide rail members 220*a*/220*b*, as shown, corresponding to the lengths of the wall members 210*a*/210*b*/210*c*, respectively.

Likewise, the third extension 130*c* can include multiple members that correspond to the multiple wall members 210*a*/210*b*/210*c*, shown as extension members 230*a*/230*b*/230*c* that are coupled to tops of the wall members 210*a*/210*b*/210*c*, respectively. In at least one other embodiment, the third wall 110*c* can be formed from a single curved member (not shown). In at least one other embodiment, the third extension 130*c* can likewise be formed from a single curved member (not shown). In at least one embodiment, the third wall 110*c* can include two walls that form a "V" (not shown) at a back of the ground excavation shield, and the third extension 130*c* can likewise be formed from two extensions (not shown) forming a "V".

Figure 9:
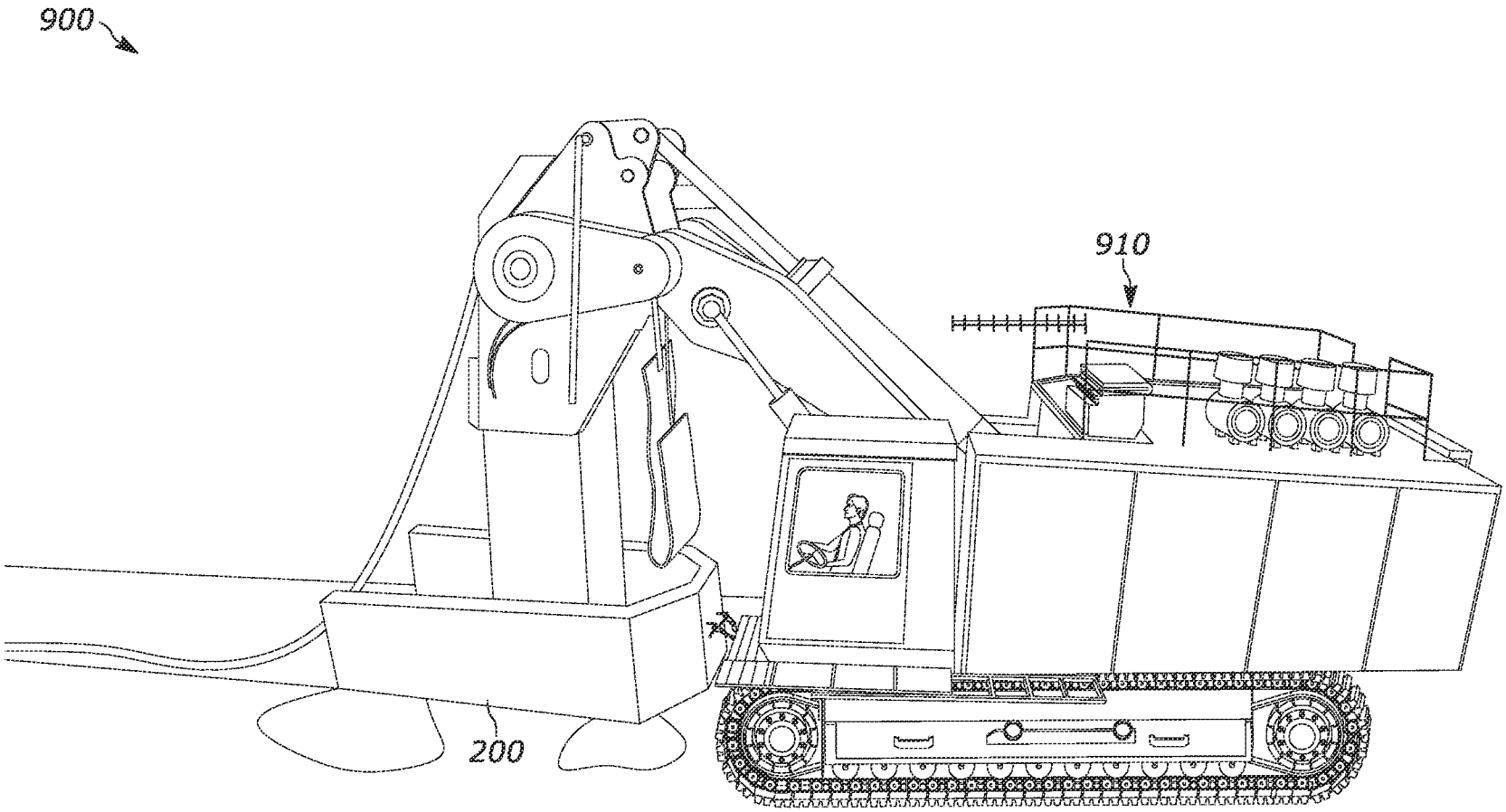
FIG. 9 illustrates an example system including the ground excavation shield shown in FIG. 2, in accordance with at least one embodiment disclosed herein.

In at least one embodiment, the ground excavation shield 200 can further include at least one coupler, such as couplers 250*a* and 250*b* that are coupled to at least one of the walls of the ground excavation shield 200, such as the third wall 110*c*. The couplers 250*a*/250*b* can be used to couple the ground excavation shield 200 to a ground excavator, such as a trencher 910 (FIG. 9), together forming a system 900, while dragging the ground excavator shield 100 across the ground 140 during trenching. In the example shown, the couplers 250*a*/250*b* are coupled to the central wall member 210*a*.

Figure 7:
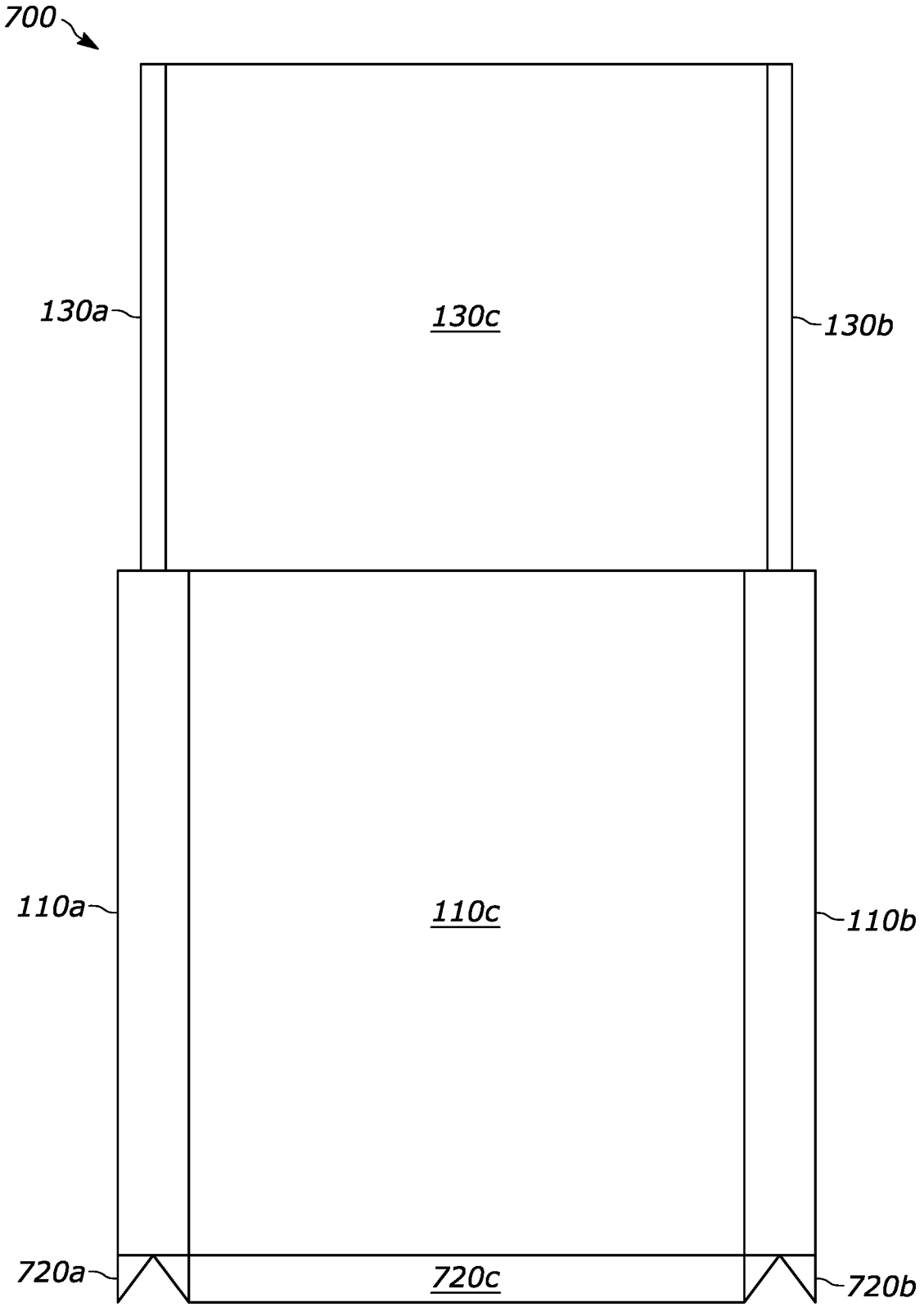
FIG. 7 illustrates a front view of yet another example ground excavation shield, in accordance with at least one embodiment disclosed herein.

In at least one embodiment, the first, second, and third guide rails 120*a*/120*b*/120*c* can be "V" shaped, as shown in FIGS. 1-5. In at least one other embodiment, other shapes can be used for guide rails, such a ground excavation shield 600 having first, second, and third guide rails 620*a*/620*b*/620*c*, shown in FIG. 6 having a "W" shape. In at least one other embodiment, a ground excavation shield 700 can have first, second, and third guide rails 720*a*/720*b*/720*c* having an inverted "V" shape, as shown in FIG. 7. Although three exemplary shapes are shown for the guide rails, it is contemplated that any shape for the guide rails can be used that at least mitigates the ground excavation shield disclosed herein from not tracking in a straight line while being dragged and that at least mitigates a ground excavation shield from moving along the ground relatively easily when unintentionally bumped by a heavy construction equipment excavator.

Depending upon needs of a particular job site, the first, second, and third walls 110*a*/110*b*/110*c* may not be tall enough to contain a desired amount of dirt and other debris from escaping an excavation site between the first, second, and third walls 110*a*/110*b*/110*c*. In at least one embodiment, the ground excavation shield 200 further includes at least one extension coupled to the top 101 of the ground excavation shield 200. At least one of a first, second, and third extension 130*a*/130*b*/130*c* can be coupled to the first, second, and third walls 110*a*/110*b*/110*c*, respectively. The first, second, and third extension 130*a*/130*b*/130*c* can be coupled to the first, second, and third walls 110*a*/110*b*/110*c* via welding, bolting, bonding, and/or any other way that prevents the first, second, and third extension 130*a*/130*b*/130*c* from detaching easily from the first, second, and third walls 110*a*/110*b*/110*c*, respectively, while the ground excavation shield 200 is used on a work site.

In at least one embodiment, the first, second, and third extension 130*a*/130*b*/130*c* can be coupled to each other where they meet, as shown, via welding, bolting, bonding, and/or any other way that prevents the first, second, and third extension 130*a*/130*b*/130*c* from detaching from each other. The height of the first, second, and third extensions 130*a*/130*b*/130*c* can vary depending upon needs. In at least one embodiment, since the first, second, and third extensions 130*a*/130*b*/130*c* provide supplemental containment for dirt and debris, while not providing structural support for the ground excavation shield 200 as that provided by the first, second, and third walls 110*a*/110*b*/110*c*. Thus, a thickness of the first, second, and third extensions 130*a*/130*b*/130*c* can be substantially less than that of the first, second, and third walls 110*a*/110*b*/110*c*, as shown, which also reduces the overall weight of the ground excavation shield 100.

Figure 8:
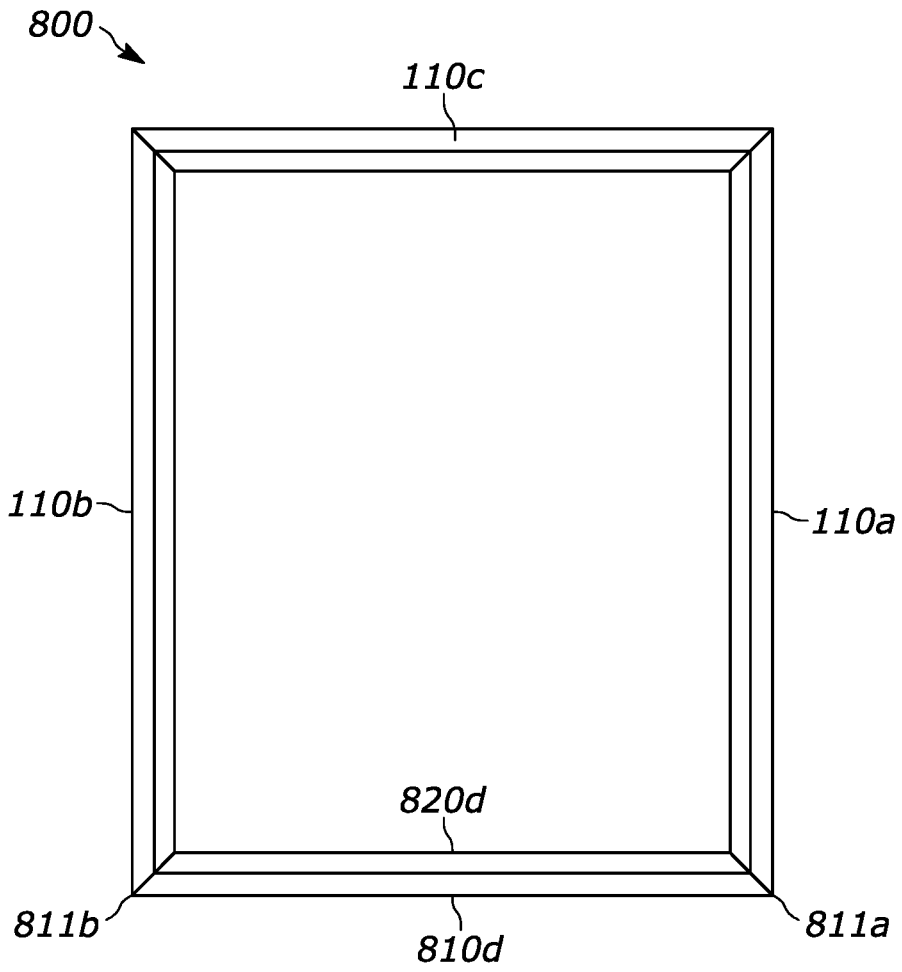
FIG. 8 illustrates a bottom view of even yet another example ground excavation shield, in accordance with at least one embodiment disclosed herein.

With reference to FIG. 8, another embodiment of an apparatus is disclosed, a ground excavation shield 800. Depending upon needs of a particular work site, when it is desired to further mitigate ground and debris from escaping an area bound by the ground excavation shield 800, in at least one embodiment the ground excavation shield 800 can include a fourth wall 810*d*. As shown the fourth wall 810*d* is coupled to ends of the first wall 110*a* and the second wall 110*b*, as shown. In the configuration shown, the fourth wall 810*d* is coupled to the first and second walls 110*a* and 110*b* at first and second ends 811*a*/811*b* of the fourth wall 810*d*, wherein the first and second ends 811*a*/811*b* meet the first and second walls 110*a* and 110*b*, respectively. In at least one embodiment, the fourth wall 810*d* can include a fourth guide rail 820*d* coupled to a bottom of the fourth wall 810*d*.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A ground excavation shield, structurally configured to be dragged by a ground excavator during trenching, the ground excavation shield comprising:

a first wall disposed on a first side of the ground excavation shield;

a second wall disposed on a second side of the ground excavation shield;

a third wall disposed on a third side of the ground excavation shield and coupled at a first end to the first wall and at a second end to the second wall thereby spanning between the first and second walls, the third wall having a central portion that is substantially perpendicular to the first and second walls, and the third wall further including a first side wall portion disposed obliquely between the central portion of the third wall and the first wall, with a second side wall portion disposed obliquely between the central portion of the third wall and the second wall;

a first guide rail coupled to a bottom of the first wall, the first guide rail comprises an outward "V" shape with a centrally located peak;

a second guide rail coupled to a bottom of the second wall, the second guide rail comprises an outward "V" shape with a centrally located peak; and a third guide rail, coupled to a bottom of the third wall, the third guide rail comprises an outward "V" shape with a centrally located peak, wherein the third wall is fixedly coupled to the first end of the first wall and the second end of the second wall by at least one of welding and bonding.

2. The ground excavation shield according to claim 1, further comprising at least one extension coupled to at least one of the first, second, and third walls, said at least one extension positioned at a top of the ground excavation shield, so as to preclude material being excavated by a trencher from passing over at least one of the first wall, the second wall and third wall, during operation of the trencher.

3. The ground excavation shield according to claim 2, wherein the at least one extension includes three extensions, one of the three extensions being coupled to the first wall, a second extension being coupled to the second wall, and a third extensions being coupled to the third wall, at the top of the ground excavation shield.

4. The ground excavation shield according to claim 1, further comprising a pair of couplers coupled to the third wall of the ground excavation shield, the pair of couplers being spaced apart so as to be on opposite sides of a plane bisecting between the first wall and the second wall, and also spaced apart from a bottom and a top of the third wall, the pair of couplers are structurally configured to couple the ground excavation shield to a trencher while the trencher drags the ground excavation shield across a ground surface.

5. The ground excavation shield according to claim 1, wherein the central portion of the third wall is oriented at an approximately 45 degree angle relative to the first side wall portion and the second side wall portion, and wherein the first wall is oriented at an approximately 45 degree angle relative to the first side wall portion, and wherein the second side wall portion is oriented at an approximately 45 degree angle relative to the second wall.

6. The ground excavation shield according to claim 1, wherein the third wall is fixedly coupled to the first and second walls at least one of welding, bolting, and bonding.

7. A system including the ground excavation shield according to claim 1, and the system further including a ground excavator, wherein the ground excavation shield is adapted to be dragged across the ground surface by the ground excavator during trenching.

8. The system according to claim 7, wherein the ground excavator is a trencher.

9. A method of use of the ground excavation shield of claim 1, the method comprising:

providing the ground excavation shield, the ground excavation shield further comprising a pair of couplers coupled to the third wall of the ground excavation shield, the pair of couplers being spaced apart so as to be on opposite sides of a plane bisecting between the first wall and the second wall;

providing a ground excavator;

coupling a first one of the pair of couplers of the ground excavation shield to the ground excavator;

coupling a second one of the pair of couplers of the ground excavation shield to the ground excavator;

positioning a portion of the ground excavator within a cavity defined by the first wall, the second wall and the third wall, the portion within the cavity being configured to trench;

activating the ground excavator so as to trench the ground between the first wall, the second wall and the third wall that define the cavity;

using the ground excavator to drag the ground excavation shield during trenching so that the ground excavator and the ground excavation shield move together during trenching.

10. The method of claim 9, wherein the ground excavator comprises a trencher.

* * * * *